US005539626A

United States Patent [19]

Scholz

[11] Patent Number: 5,539,626

[45] Date of Patent: Jul. 23, 1996

[54] OPERATING THEATER LAMP

[75] Inventor: Manfred K. H. Scholz, Seitingen, Germany

[73] Assignee: Delma electro-und medizinische Apparatebau Gesellschaft mbH, Tuttlingen, Germany

[21] Appl. No.: 225,200

[22] Filed: Apr. 8, 1994

[30] Foreign Application Priority Data

Nov. 18, 1993 [DE] Germany ..... 9317671 U

[51] Int. Cl.[6] ..... F21S 1/02; F21V 23/04

[52] U.S. Cl. ..... 362/249; 362/250; 362/251; 362/804

[58] Field of Search ..... 362/240, 249, 362/804, 250, 251, 295

[56] References Cited

U.S. PATENT DOCUMENTS

| | | | |
|---|---|---|---|
| 2,114,664 | 4/1938 | Gelb . | |
| 2,173,325 | 9/1939 | Alexander . | |
| 2,215,531 | 9/1940 | Pieper | 362/804 |
| 2,297,781 | 10/1942 | Korengold | 362/804 |
| 3,201,582 | 8/1965 | Siegel | 362/295 |
| 3,702,928 | 11/1972 | Alger | 362/804 |
| 3,928,757 | 12/1975 | Nelson | 362/804 |
| 4,204,274 | 5/1980 | Luderitz | 362/240 |
| 5,038,254 | 8/1991 | Fabbri et al. | 362/804 |
| 5,093,769 | 3/1992 | Luntsford | 362/804 |
| 5,272,608 | 12/1993 | Engle | 362/240 |
| 5,347,431 | 9/1994 | Blackwell et al. | 362/804 |

FOREIGN PATENT DOCUMENTS

| | | | |
|---|---|---|---|
| 133929 | 4/1928 | France . | |
| 3506030 | 8/1986 | Germany | 362/217 |
| 90 17 143 U | 4/1991 | Germany . | |
| 4140325 | 6/1993 | Germany . | |

*Primary Examiner*—Denise L. Gromada
*Assistant Examiner*—Sara Sachie Raab
*Attorney, Agent, or Firm*—Townsend and Townsend and Crew

[57] ABSTRACT

An operating theater lamp especially adapted for medical operations carried out using endoscopes has a housing (11), a reflector (12) and a main light source (13). Additional lamps (17*a;* 17*b*) are arranged on the housing (11) which respectively transmit an auxiliary light beam (18) in the opposite direction to the main light beam (19).

8 Claims, 2 Drawing Sheets

OPERATING THEATER LAMP

BACKGROUND OF THE INVENTION

The invention relates to an operating theatre lamp.

When medical operations are carried out with endoscopes a very intensive illumination must first be made available by an operating theatre lamp, for example in order to place the trocars which are necessary. After the endoscope has been pushed in at the site of the operation the bright light of the operating theatre lamp is however frequently disturbing and the operator is frequently undesirably dazzled. Accordingly, with such endoscopic operations, the main light is generally switched off and a subdued, dazzle-free, dimmed light is switched on in place of it so that the operator can still see. However, for this purpose a second illuminating system must be available, for example the room lighting. The room lighting is however not generally laid out for the generation of a softened light and must accordingly be modified.

SUMMARY OF THE INVENTION

The object of the present invention is now to provide an operating theatre lamp of the initially named kind with which the surgeon can work at any time with ideal light conditions.

In order to satisfy this object there is provided, in accordance with the present invention, an operating theatre lamp comprising a housing which is preferably adjustably arranged on a wall, on a ceiling or on a stand, wherein one or more reflectors are provided in the housing and one or more light sources are located in the optical centers of the reflectors, with the light of the light sources being directed by the reflector via one or more light exit openings provided at one side of the housing, preferably at the lower side, to a site of an operation, the light exit openings being preferably covered over by one or more light permeable plate arrangements, the operating theatre lamp being characterised in that one or more additional lamps are arranged on or in the housing.

The concept underlying the invention is thus to be seen in the fact that the housing of the operating theatre lamp is itself provided with one or more additional lamps which are preferably switched with the same switching means as the main light source. In particular, when switching off the main light source the additional lamp or the additional lamps should be automatically switched on.

Since special additional lamps are provided on or in the lamp housing itself, to provide the desired dimmed light which is required after the switching off of the main light source, it is straightforwardly possible to ideally match these additional lamps with respect to their light strength, light scattering angle, light direction and/or light colour to the desired application during endoscopic operations. The main light source can be formed in the customary manner and does not need to be adapted in any way to the additional lamps which are integrated into the operating theatre lamp.

The invention will be described in the following by way of example and with reference to the drawings in which are shown:

DESCRIPTION OF THE PREFERRED EMBODIMENT

Figure 1:
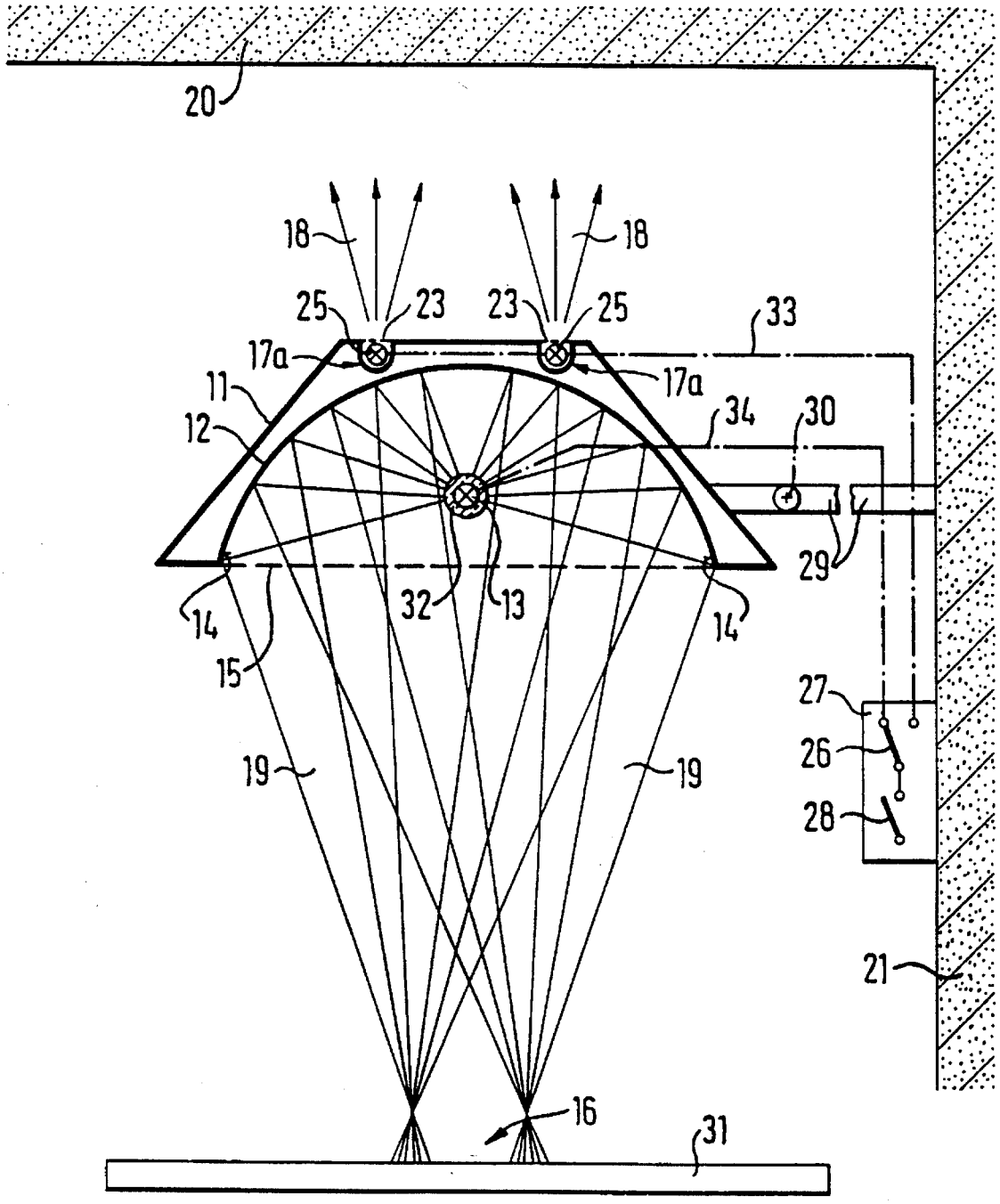
FIG. 1 a first embodiment of an operating theatre lamp in accordance with the invention with two built-in additional lamps, and FIG. 2 a further embodiment of an operating theatre lamp in accordance with the invention with two externally attached additional lamps.

In FIG. 1 a linkage 29, which is only schematically illustrated, contains a preferably fixable hinge 30 and is secured to the wall 21 of an operating theatre. The housing 11 of an operating theatre lamp is fixedly attached to the free end of the linkage 29, so that the housing 11 is held on the wall 21 by the linkage 29. In this way the housing 11 is adjustably held relative to an operation site 16 which is provided closely above an operating table 31 and at a clear distance beneath the housing 11.

A reflector 12 is arranged within the lamp housing 11 and a main light source 13 is located at the optical center of this reflector 12 and can be surrounded by an infrared filter 32.

The reflector 12 reflects the light transmitted from the main light source 13 to a light exit opening 14 provided at the lower side of the housing 11, with this opening 14 being closed off by a light permeable plate 15 which is only indicated in broken lines. In this manner a main light beam 19 arises which is directed to the site 16 of the operation.

Two additional lamps 17*a* are built into the lamp housing 11 above the reflector 12 and are closed off at the top by light permeable covers 23. The additional lamps 17*a* contain additional light sources 25 which transmit auxiliary light beams 18 upwardly to the ceiling 20 of the room.

The auxiliary light sources 25 can be interchanged by removal of the light permeable covers 23 or of the lamp housing 24.

The main light source 13 and the additional light sources 25 are electrically connected via cables 33, 34, which are only indicated in broken lines, to a switch box 27 secured to the wall 21. A change-over switch 26 and a main switch 28 are accommodated in the switch box 27.

The operation of the described operating theatre lamp is as follows:

First of all the main switch 28 is closed and the change-over switch 26 is brought into the position evident from FIG. 1, whereby the main light source 13 is switched on and the additional lamps 17*a*, 17*b* are switched off. The housing 11 is then ideally aligned with the site of the operation, for example by pivoting about the hinge 30. If provided with a lock or fixing device the hinge 30 can be locked to ensure the operating theatre lamp remains in the selected position.

After a trocar has been brought to the site 16 of the operation and an endoscope has been introduced into the trocar the surgeon, or an auxiliary, operates the change-over switch 26 whereby the main light source 13 is switched off and the additional lamps 17*a* are switched on. They thereby each transmit an auxiliary light beam 18 to the ceiling 20 of the room from where the light is scatteringly distributed over the entire room and a strongly subdued lighting is obtained at the site of the operation.

Figure 2:
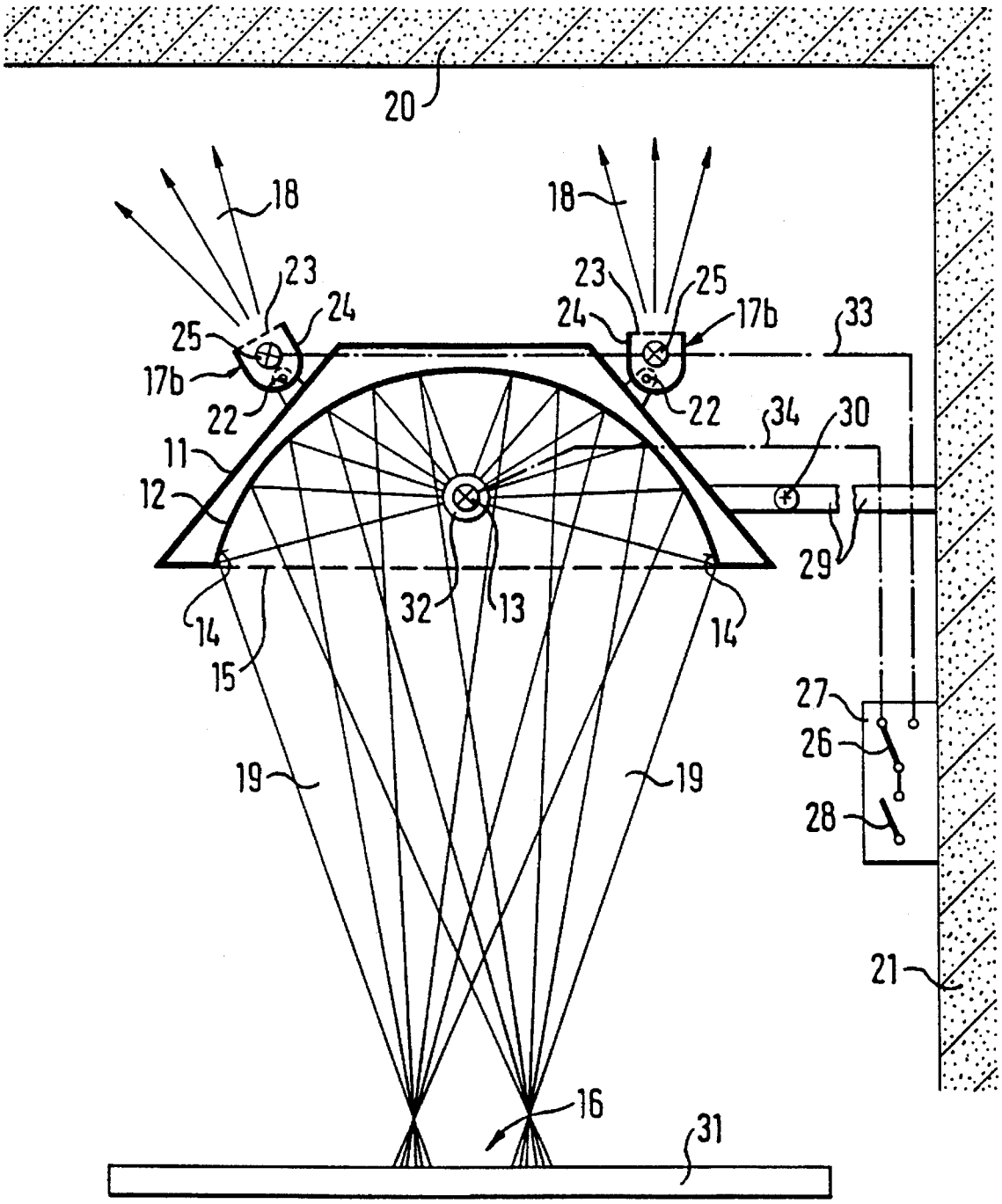

In FIG. 2 the same reference numerals refer to components which correspond to components of FIG. 1.

In distinction to the embodiment of FIG. 1 the additional lamps 17*b* in the embodiment of FIG. 2 are not built into the lamp housing 11 but are rather secured to it at the sides and/or at the top and are indeed preferably pivotable about one or more axes of rotation 22 which stand perpendicular to one another. In this way the auxiliary light beams 18 which emerge from the lamps 17*b* receive a desired direction independently of the position of the housing 11. Thus it can be seen from FIG. 2 that the right hand additional lamp 17*b* radiates substantially vertically upwardly, whereas the left hand additional lamp 17*b* transmits its light beam 18 obliquely towards the ceiling 20.

I claim:

1. An operating theatre lamp comprising:

a housing adapted for adjustable attachment to a support and having a lower side with at least one light exit opening;

at least one reflector provided in the housing and having an optical center;

at least one light source located in the optical center of the reflector, the light source including a bright main light directed by the reflector via the light exit opening to a site of a medical operation, the light exit opening being covered over by a light permeable plate arrangement;

at least one additional lamp mounted to the housing, the additional lamp being arranged to direct a light beam in the opposite direction from the bright main light and away from the site of the medical operation, the additional lamp providing a subdued, dimmed light relative to the bright main light;

a switch operatively coupled to the housing for alternatively switching the bright main light and the additional lamp ON and OFF; and a main switch for turning the switch on and off.

2. The operating theatre lamp of claim 1 wherein the additional lamp is integrated into the housing.

3. The operating theatre lamp of claim 1 wherein the additional lamp is mounted on the housing.

4. The operating theatre lamp of claim 1 wherein the additional lamp is pivotally mounted about at least one axis.

5. The operating theatre lamp of claim 1 wherein the additional lamp is formed by a halogen reflector lamp.

6. The operating theatre lamp of claim 1 wherein the additional lamp is covered over by a light permeable cover.

7. The operating theatre lamp of claim 6 wherein the cover is formed as a scattering disk.

8. The operating theatre lamp of claim 6 wherein the additional lamp has a cover and a light source, the light source of the additional lamp being changable by removing the cover.

* * * * *